US009301621B2

(12) United States Patent
Barstad et al.

(10) Patent No.: US 9,301,621 B2
(45) Date of Patent: Apr. 5, 2016

(54) COLLAPSIBLE MARSH STOOL

(71) Applicants: Theodore William Barstad, Discovery Bay, CA (US); Sean P. McDermott, Los Altos Hills, CA (US)

(72) Inventors: Theodore William Barstad, Discovery Bay, CA (US); Sean P. McDermott, Los Altos Hills, CA (US)

( * ) Notice: Subject to any disclaimer, the term of this patent is extended or adjusted under 35 U.S.C. 154(b) by 0 days.

(21) Appl. No.: 14/450,176

(22) Filed: Aug. 1, 2014

(65) Prior Publication Data

US 2015/0054328 A1 Feb. 26, 2015

Related U.S. Application Data

(60) Provisional application No. 61/868,860, filed on Aug. 22, 2013.

(51) Int. Cl.

| | |
|---|---|
| ***A47C 1/00*** | (2006.01) |
| ***A47C 9/10*** | (2006.01) |
| ***A47C 4/02*** | (2006.01) |
| ***A47C 4/03*** | (2006.01) |

(52) U.S. Cl.
CPC . *A47C 9/10* (2013.01); *A47C 4/022* (2013.01); *A47C 4/03* (2013.01)

(58) Field of Classification Search
CPC ..... A47C 4/022; A47C 4/03; A47C 9/10
USPC ..... 297/4, 16.1
See application file for complete search history.

(56) References Cited

U.S. PATENT DOCUMENTS

| | | | | | |
|---|---|---|---|---|---|
| 401,302 | A * | 4/1889 | Purdy | 297/451.4 | |
| 444,621 | A * | 1/1891 | Schneider | 248/155.1 | |
| 1,379,129 | A * | 5/1921 | Sejnoha | A47C 9/10 108/148 | |
| 1,709,200 | A * | 4/1929 | Westbrook et al. | 297/4 X | |
| 2,625,985 | A * | 1/1953 | Morgan | A47C 9/10 248/121 | |
| 2,690,211 | A * | 9/1954 | Wentz | A45B 5/00 248/155.1 | |
| 2,720,249 | A * | 10/1955 | Peterson | A47C 9/10 108/141 | |
| 2,877,828 | A * | 3/1959 | Barnette, Jr. | A01K 97/10 108/28 | |
| 3,266,839 | A * | 8/1966 | Combs | 297/57 | |
| 3,283,733 | A * | 11/1966 | Boerma | A01M 31/02 108/150 | |
| 3,467,033 | A * | 9/1969 | Remer et al. | 108/150 | |
| 3,985,387 | A * | 10/1976 | Rischar | 297/4 | |
| 4,085,686 | A * | 4/1978 | Turner et al. | 108/25 | |
| 4,098,478 | A * | 7/1978 | Spitzke | 297/4 X | |
| 4,101,163 | A * | 7/1978 | Morin | 297/4 X | |
| 4,130,294 | A * | 12/1978 | Walker | 280/812 | |
| 4,366,981 | A * | 1/1983 | Ziegler et al. | 297/4 X | |
| 4,433,870 | A * | 2/1984 | Bairen et al. | 297/4 X | |
| 4,451,080 | A * | 5/1984 | Nix | 297/4 | |
| 4,676,547 | A * | 6/1987 | Spillman | 297/4 | |
| 5,673,966 | A * | 10/1997 | Morton, Jr. | 297/4 | |
| 5,720,522 | A * | 2/1998 | Habeck | 297/337 | |
| 6,176,545 | B1 * | 1/2001 | Hambleton | 297/4 | |
| 6,893,097 | B1 * | 5/2005 | Ebensperger et al. | 297/4 X | |

(Continued)

*Primary Examiner* — Rodney B White

(74) *Attorney, Agent, or Firm* — Beeson Skinner Beverly, LLP

(57) ABSTRACT

A collapsible marsh stool comprises a seat, an anchoring post and a pair of retaining flanges depending from the underside of the seat, in a deployed configuration the anchoring post fitting in an opening in the top end of a telescoping support leg, and the support leg received in the center hole of a mud plate such that the mud plate is slidingly disposed on the leg, upward movement of the mud plate limited by a stop on the leg, and a collapsed configuration in which the mud plate is disposed adjacent the seat's underside with the anchoring post removably received in the mud plate's center hole, the leg removably retained in the apertures of the retaining flanges, and the side edge of the mud plate captured between the leg and the underside of the seat.

8 Claims, 6 Drawing Sheets

(56) References Cited

U.S. PATENT DOCUMENTS 6,997,511 B2 * 2/2006 Marchand et al. ..... 297/314
7,285,056 B1 * 10/2007 Whitt ..... 473/277
7,325,868 B2 * 2/2008 West et al. ..... 297/4
7,396,083 B2 * 7/2008 Kasner ..... 297/4 X
9,066,592 B2 * 6/2015 Kinczkowski ..... A47C 9/10
2005/0242630 A1 * 11/2005 Miller ..... 297/4

* cited by examiner

COLLAPSIBLE MARSH STOOL

BACKGROUND

1. Field of the Invention

This invention relates to portable seats and particularly to portable stools for use during recreational activities in marshy field conditions. In one embodiment, the stool is collapsible from a deployed configuration to a collapsed configuration for improved portability.

2. Description of Related Art

Participation in waterfowling involves spending time in challenging marshy field conditions where waterfowl are more likely to be found. Over time various forms of portable seats have become available to provide added comfort while bivouacked. It can be inconvenient, however, to carry a seat or stool to a field site along with other equipment generally required. Therefore, a need exists for a marsh stool that is easier and more convenient to carry to a field site, and to set up and breakdown, during waterfowling or other field activities.

DETAILED DESCRIPTION OF THE ILLUSTRATED EMBODIMENT

Figure 1:
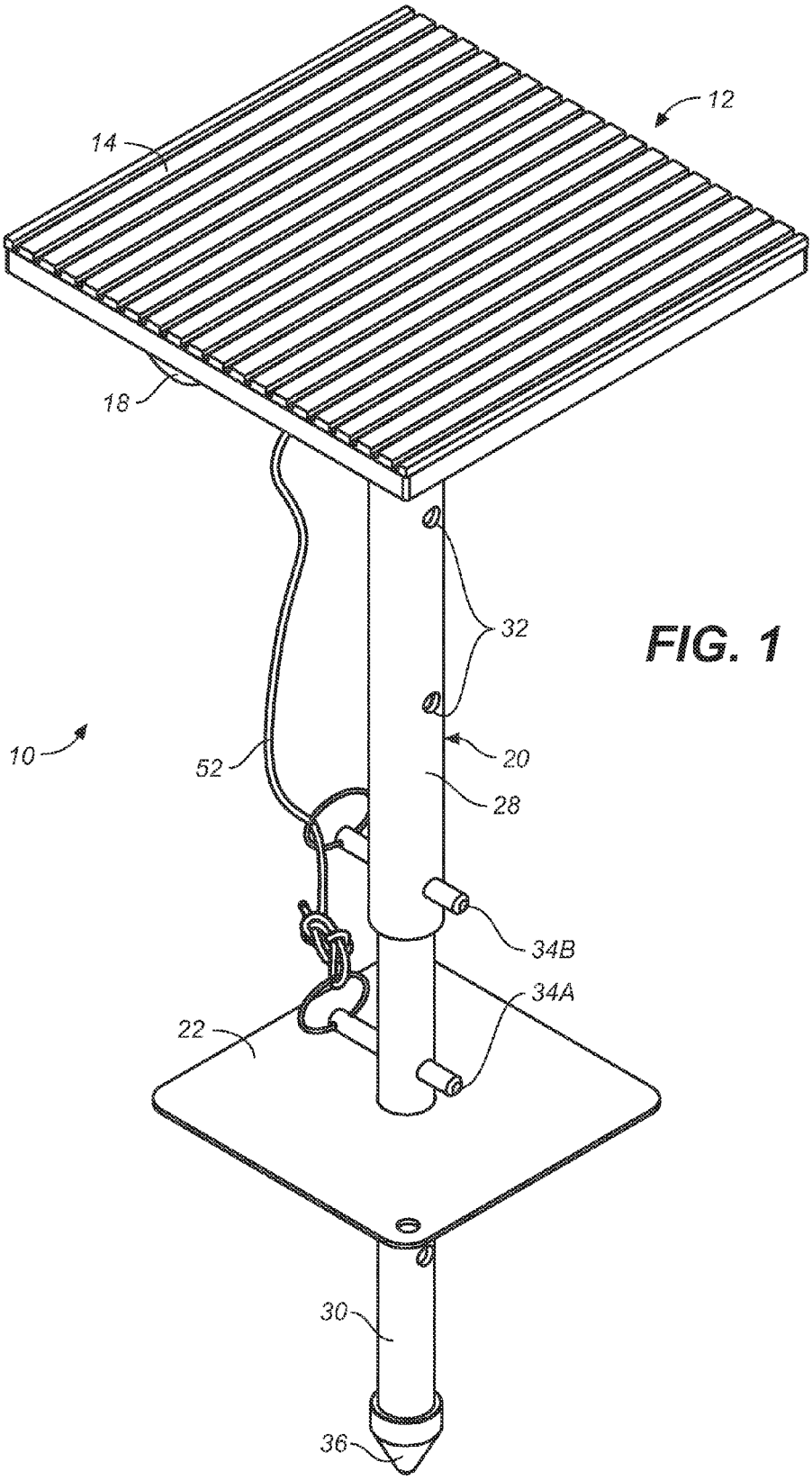
FIG. 1 is an upper perspective view of a collapsible marsh stool in a deployed configuration according to the invention.
Figure 2:
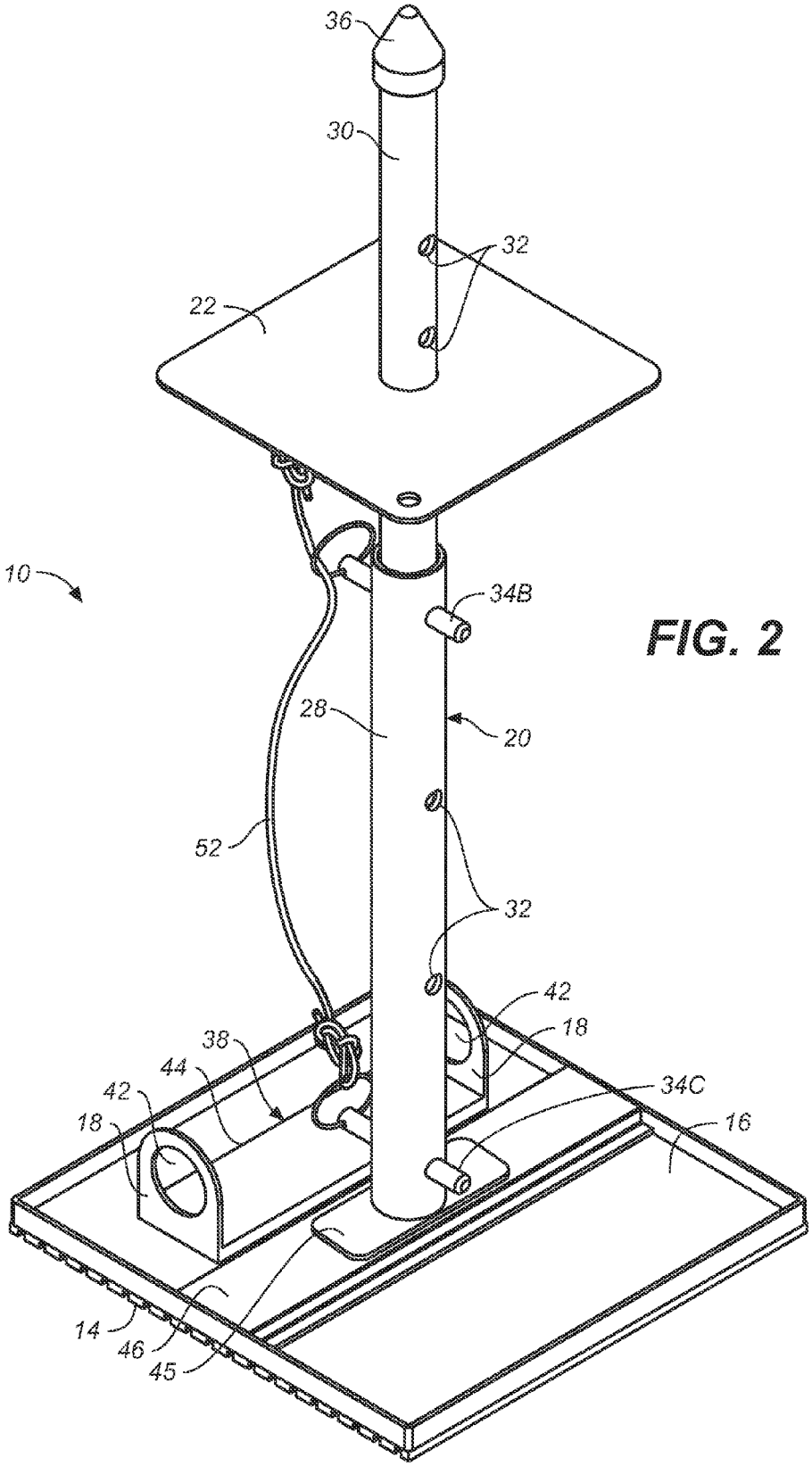
FIG. 2 is a bottom perspective view thereof.
Figure 3:
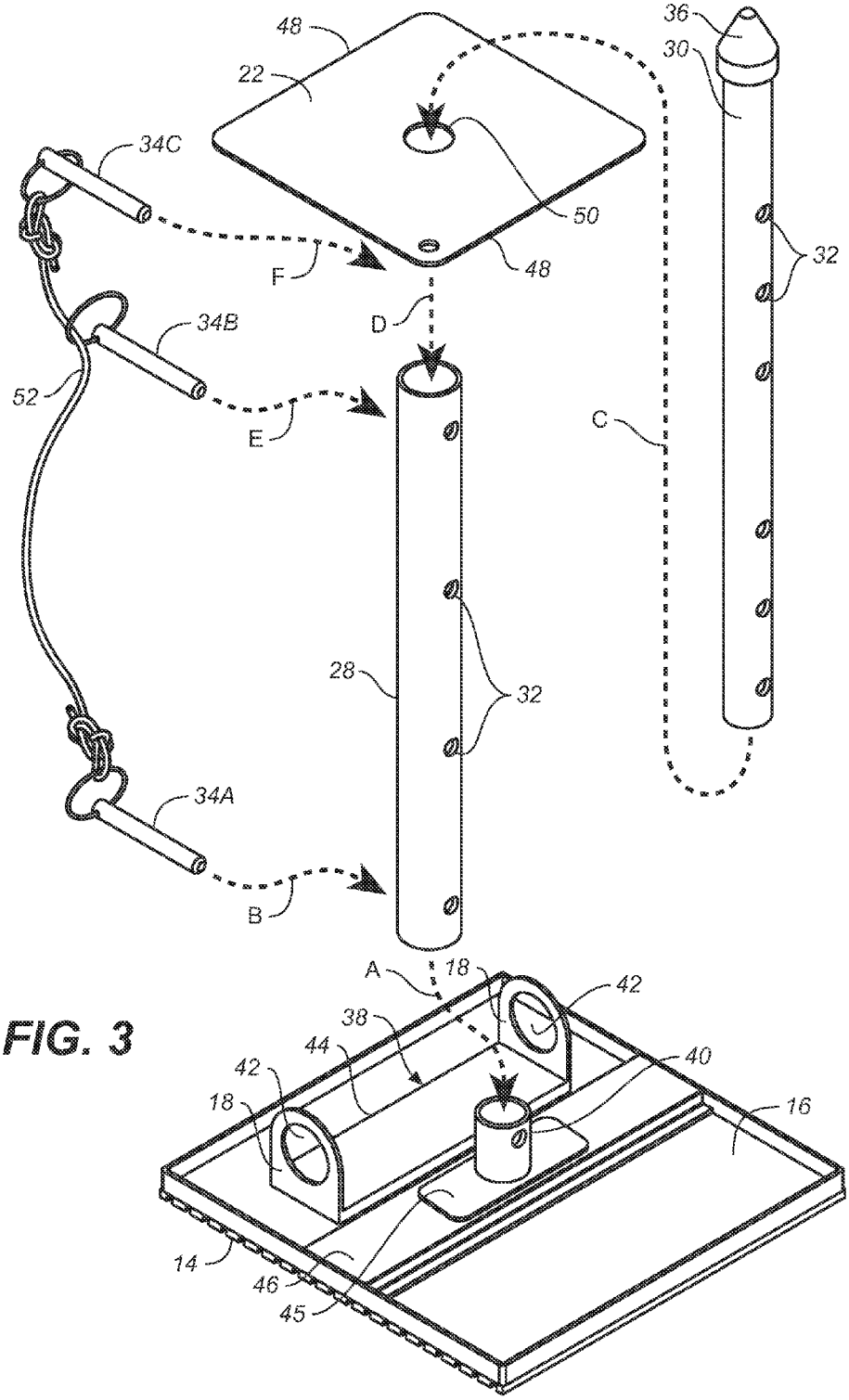
FIG. 3 is an exploded bottom perspective view thereof.
Figure 4:
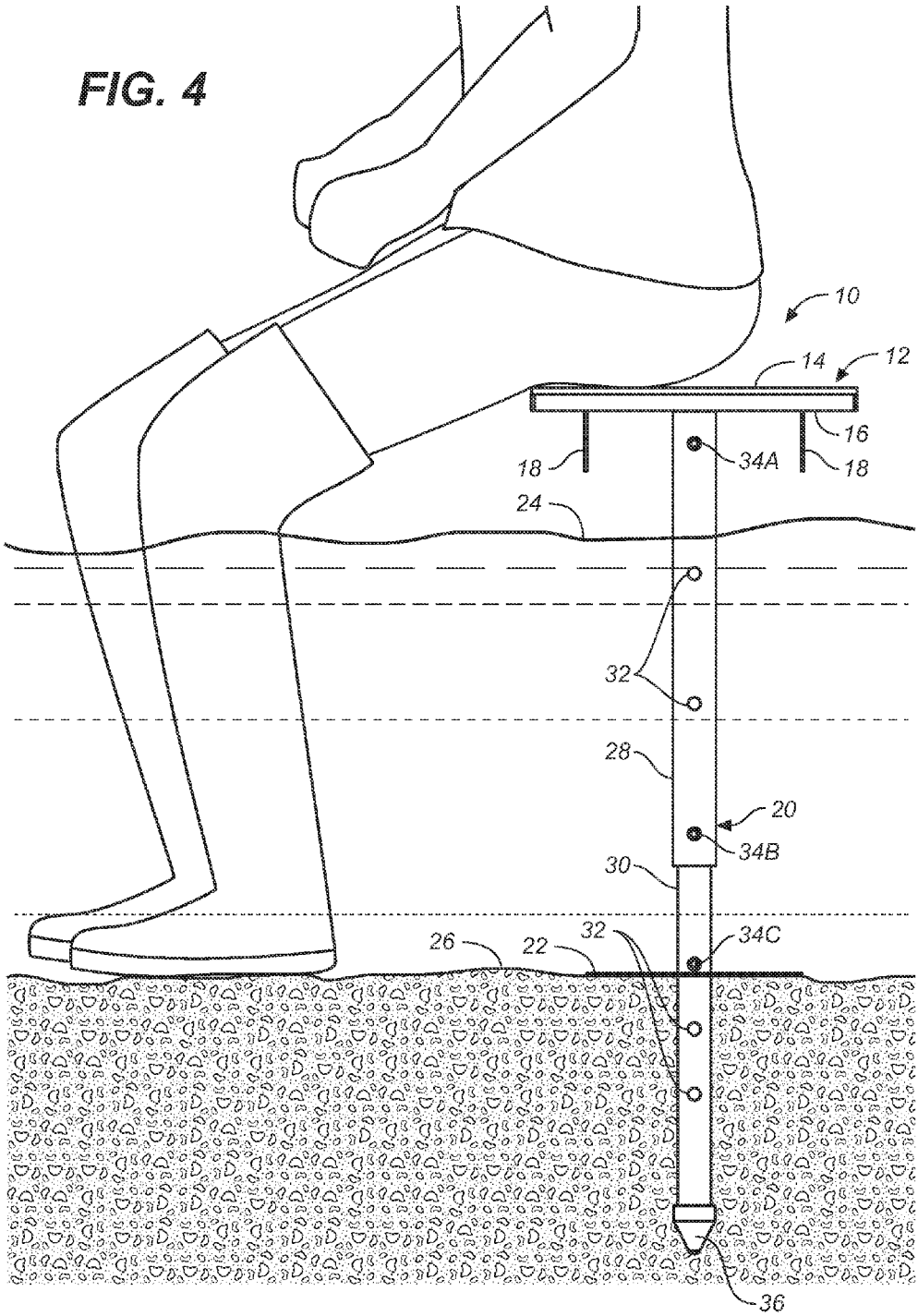
FIG. 4 is side elevational view thereof showing the collapsible marsh stool deployed in a marshy field setting.
Figure 5:
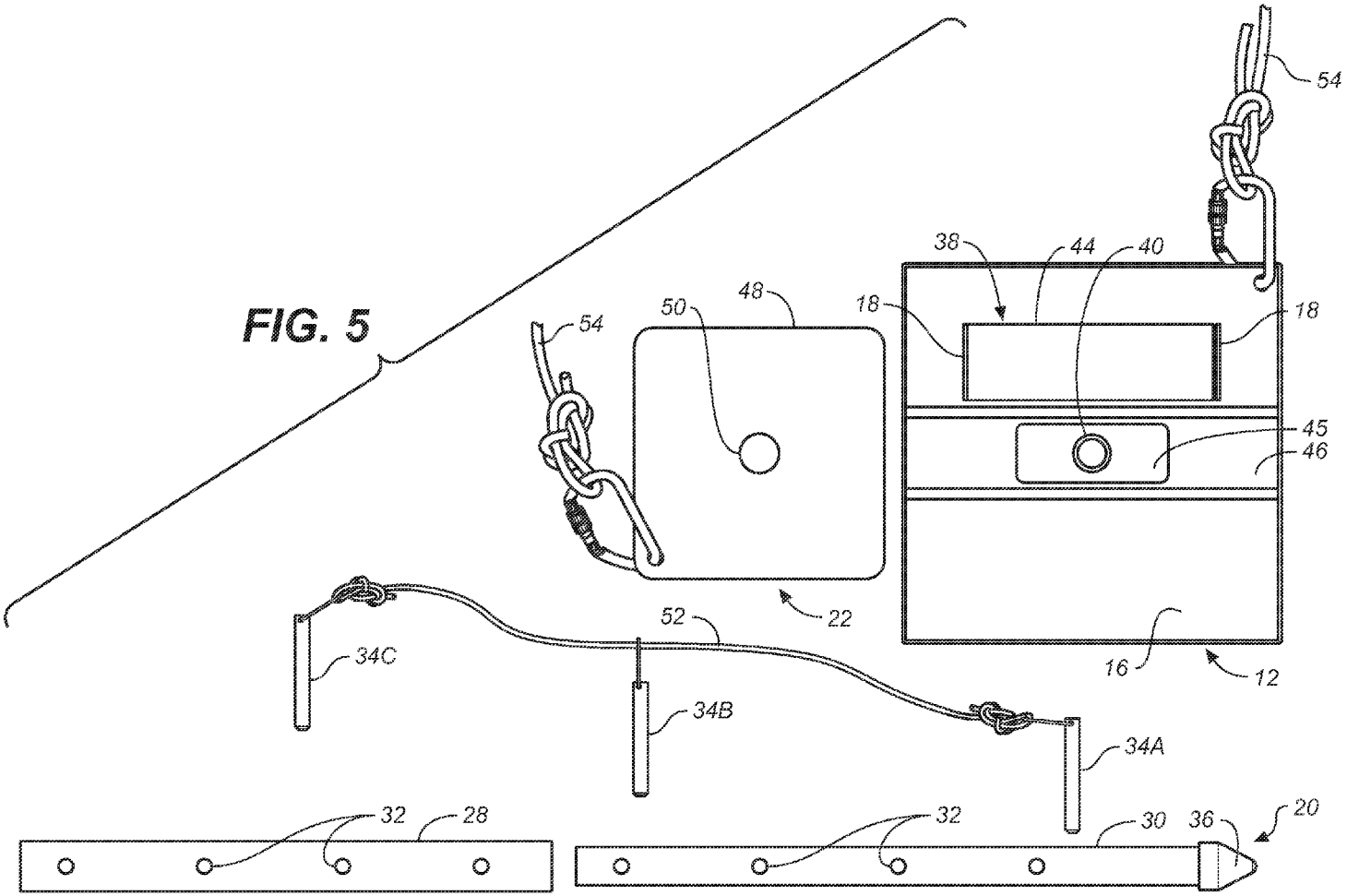
FIG. 5 is a plan view of the disassembled components of a collapsible marsh stool.
Figure 6:
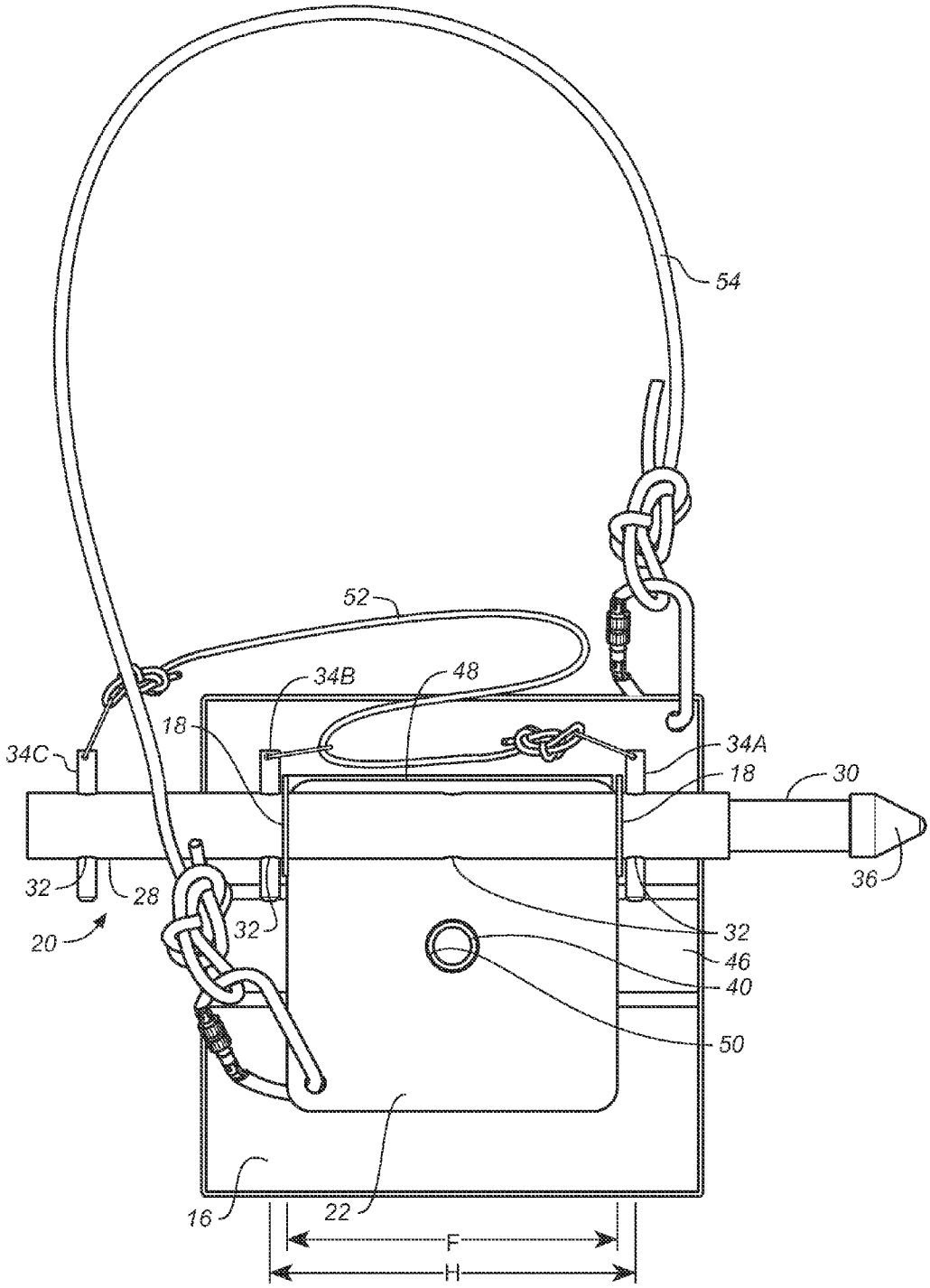
FIG. 6 is a plan view thereof in a collapsed configuration.

A collapsible marsh stool is referred to generally at 10 in FIGS. 1 and 2. According to the invention the collapsible marsh stool comprises a seat 12 having a seating surface 14, an underside 16, a pair of retaining flanges 18, a telescoping support leg 20, and a mud plate 22. The marsh stool may be arranged in a deployed configuration, as shown in FIGS. 1, 2 and 4, or a collapsed configuration, as shown in FIG. 6. FIGS. 3 and 5 illustrate the simple steps involved in assembling the marsh stool in either the deployed configuration or the collapsed configuration.

As seen in FIG. 4, in the deployed configuration the support leg 20 of the marsh stool extends downwardly from the seat 12 through a body of water 24, such as may be commonly experienced in marshy environments, into a ground surface 26 where it stabilizes. As seen, when the mud plate 22 engages the ground surface 26, sufficient resistance is encountered that further downward penetration of the support leg 20 is limited.

In the illustrated embodiment, support leg 20 includes an outer tube 28 and an inner tube 30 slidably received in the outer tube and that can be extended therefrom so that leg 20 can be telescopically extended to a selected length as may be appropriate for field conditions. The outer and inner tubes 28, 30 are provided with a plurality of corresponding locking holes 32 for use with locking pins 34 to secure the leg 20 to the seat 12, to lock the outer and inner tubes 28, 30 in a desired length, and to limit upward movement of the mud plate 22 along leg 20 as appropriate for field conditions, as discussed in greater detail below. In one aspect of the invention, the bottom end of leg 20 may be equipped with a tapered tip 36 to facilitate insertion of the leg into the ground. Those of skill in the art will understand that, while the leg segments 28, 30 are illustrated as being tubular, other shapes may also be suitable, such as a square cross-section.

With reference to FIG. 3, it is seen that the underside 16 of the seat 12 includes an integrated retaining bracket 38 and an anchoring post 40. The retaining bracket 38 includes a pair of retaining flanges 18 extending perpendicularly from the underside 16 of the seat 12. Each retaining flange 18 has a leg-holding opening 42. While in the illustrated embodiment flanges 18 are shown as extending from a base segment 44 of retaining bracket 38 which is attached to the underside 16 of the seat 20, in an alternate embodiment the flanges 18 are attached directly to the seat's underside 16. In the illustrated embodiment, plate 45 is secured to the surface of reinforcing cross-bar 46 to guard against wear-and-tear on the cross-bar 46 that may be caused by the outer tube 28 of the support leg.

In FIG. 5 it is seen that the collapsible marsh stool has been disassembled into its individual components. It will be noted that the mud plate 22 includes side edges 48 and a center hole 50.

In the collapsed configuration shown in FIG. 6, the inner tube 30 of leg 20 has been telescoped within outer tube 28 and that outer tube 28 has been inserted into the openings 42 (see again FIGS. 2 and 3) of flanges 18. Mud plate 22 is resting against impact plate 45 and base segment 44 of the retaining bracket 38. Anchoring post 40 is disposed in the center hole 50 of mud plate 22 and one side edge 48 of mud plate 22 is trapped between flanges 18 and captured between impact plate 45 and the outer tube 28 of leg 20. In this configuration, mud plate 22 is restrained against lateral movement across the underside 16 of the seat 20 by the anchoring post 40, restricted from rotation about anchoring post 40 by flanges 18, and prevented from separating from the underside 16 of seat 12 by leg 20 and post 40. It will be understood that anchoring post 40 must have at least a minimum length to prevent the mud plate 22 from separating from seat 12.

With continued reference to FIG. 6, it is seen that three locking pins 34A, 34B and 34C are inserted in cooperating locking pin holes 32 in the outer and inner tubes 28, 30 of support leg 20. Locking pins 34A and 34B are removably inserted in a pair of locking holes that are spaced apart a distance H slightly greater than the distance F by which the retaining flanges 18 are spaced apart, such that the side edge 48 of mud plate 22 is closely confined between the flanges 18. Locking pin 34C is removably stored in a third set of locking holes 32 as shown. In the illustrated embodiment the locking pins 34A, 34B and 34C are interlinked by tie 52 and opposite ends of strap 54 are connected to mud plate 22 and seat 12. In the collapsed configuration, strap 54 acts as a convenient carrying strap, but otherwise prevents the mud plate 22 from being separated from the seat 12 such as would be undesirable under field conditions.

FIG. 3 shows how the parts of the collapsible marsh stool may be assembled in the deployed configuration. Not necessarily in the following order, the outer tube 28 of the leg 20 is placed over anchoring post 40, as indicated by arrow A, and secured in place by insertion of locking pin 34A, as indicated by arrow B. Next, the inner tube 30 of leg 20 is inserted through the center hole 50 of mud plate 22, as indicated by arrow C, and thereafter into outer tube 28, as indicated by arrow D. The outer and inner tubes 28, 30 are then locked in a selected length by insertion of locking pin 34B in aligned locking holes 32, as indicated by arrow E. Lastly, locking pin 34C is inserted in a selected locking hole 32 in inner tube 30 to establish a stop beyond which the mud plate 22 cannot travel upward along the inner tube 30 of leg 20 according to a user's preference given existing field conditions. The mud plate 22 is prevented from falling off of the support leg 20 by tip 36 which has a diameter greater than that of the mud plate's center hole 50. The collapsible marsh stool, thus assembled into its deployed configuration, is inserted in the ground in a desired location as shown in FIG. 4.

In one embodiment of the invention, seating surface 14 is comprised of 1" thick closed cell foam which is sufficiently buoyant that the marsh stool will float in either the deployed or collapsed configurations.

A collapsible marsh stool according to the invention can be easily carried to a field site while in the collapsed configuration and then quickly reconfigured on site into the deployed configuration. The invention is simple in construction, rugged, and designed for longevity.

There have thus been described and illustrated certain embodiments of a collapsible marsh stool according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A collapsible marsh stool comprising:

a seat including a seating surface, an underside opposite said seating surface, an anchoring post extending perpendicularly from said underside, and a pair of retaining flanges extending downwardly from said underside, said retaining flanges each having a leg-holding aperture, a support leg for supporting said seating surface, said leg having a top end and a bottom end, said top end having a longitudinally-extending post-receiving opening, a stop disposed between the top and bottom ends of said support leg, a mud plate including a side edge and a leg-receiving center hole, a deployed configuration in which said anchoring post is received longitudinally in the opening of the top end of said leg such that said leg is held in perpendicular relation to said seating surface, said leg is received in the center hole of said mud plate such that said mud plate is slidingly disposed on said leg, and movement of said mud plate toward the top end of said leg is limited by said stop, and a collapsed configuration in which said mud plate is disposed adjacent the underside of said seat, said anchoring post is removably received in the mud plate's center hole, said leg is removably received in the apertures of said pair of retaining flanges, the side edge of said mud plate is disposed between the retaining flanges, and the side edge of said mud plate is captured between said leg and the underside of said seat.

2. The collapsible marsh stool of claim 1 wherein:

said leg includes an outer tube and a telescoping inner tube extendably disposed in said outer tube, said outer tube having a lower edge having a diameter greater than the center hole of said mud plate, said lower edge forming said stop, said inner tube having a diameter slightly smaller than the center hole of said mud plate.

3. The collapsible marsh stool of claim 1 further comprising:

said leg including an outer tube and a telescoping inner tube extendably disposed in said outer tube, said outer tube including three or more outer tube locking holes, and said inner tube including three or more inner tube locking holes, said anchoring post having an anchoring post locking hole, and three or more locking pins, wherein, in said deployed configuration:

one of said locking pins is inserted in a first outer tube locking hole and in said anchoring post locking hole, thereby locking said outer tube to said anchoring post, one of said locking pins is inserted in a second outer tube locking hole and in a selected one of said inner tube locking holes, thereby locking said inner and outer tubes together in a selected extended length, and one of said locking pins is inserted in a second outer tube locking hole, said mud plate retained between said stop and said second outer tube locking hole.

4. The collapsible marsh stool of claim 1 wherein:

said support leg includes one or more locking holes, and said stop comprises a locking pin, in said deployed configuration said locking pin received in one of said locking holes and disposed between said mud plate and the top end of said support leg, such that said mud plate is moveable along said leg between the bottom end thereof and said stop.

5. The collapsible marsh stool of claim 1 wherein:

said pair of flanges is spaced apart by a flange separation distance, and said leg includes two or more locking holes and two or more locking pins, two of said locking holes spaced apart a distance greater than said flange separation distance, such that in said collapsed configuration when said locking pins are inserted in said two locking holes with at least one flange of said pair of flanges interposed between said two locking holes, said leg is held in the apertures of said pair of flanges.

6. The collapsible marsh stool of claim 5 wherein:

in said collapsed configuration, when two of said two or more locking pins are inserted in said two locking holes said pair of flanges is interposed between said two locking holes.

7. A collapsible marsh stool comprising:

a seat including a seating surface, an underside opposite said seating surface, an anchoring post extending perpendicularly from said underside, and a pair of retaining flanges extending downwardly from said underside, said retaining flanges each having a leg-holding aperture, a support leg for supporting said seating surface, said leg having a top end, a bottom end and one or more locking holes, said top end having a longitudinally-extending post-receiving opening, a locking pin disposed between the top and bottom ends of said support leg, a mud plate including a side edge and a leg-receiving center hole, a deployed configuration in which said anchoring post is received longitudinally in the opening of the top end of said leg such that said leg is held in perpendicular relation to said seating surface, said leg is received in the center hole of said mud plate such that said mud plate is slidingly disposed on said leg, said locking pin is received in one of said locking holes and disposed between said mud plate and the top end of said support leg such that said mud plate is moveable along said leg between the bottom end thereof and said locking pin, and movement of said mud plate toward the top end of said leg is limited by said locking pin, and a collapsed configuration in which said mud plate is disposed adjacent the underside of said seat, said anchoring post is removably received in the mud plate's center hole, said leg is removably received in the apertures of said pair of retaining flanges, the side edge of said mud plate is disposed between the retaining flanges, and the side edge of said mud plate is captured between said leg and the underside of said seat.

8. A collapsible marsh stool comprising:

a seat including a seating surface, an underside opposite said seating surface, an anchoring post extending perpendicularly from said underside, and a pair of retaining flanges extending downwardly from said underside, said retaining flanges spaced apart by a flange separation distance and each having a leg-holding aperture, a support leg for supporting said seating surface, said leg having a top end, a bottom end, two or more locking holes and two or more locking pins, said top end having a longitudinally-extending post-receiving opening, two of said locking holes spaced apart a distance greater than said flange separation distance, a stop disposed between the top and bottom ends of said support leg, a mud plate including a side edge and a leg-receiving center hole, a deployed configuration in which said anchoring post is received longitudinally in the opening of the top end of said leg such that said leg is held in perpendicular relation to said seating surface, said leg is received in the center hole of said mud plate such that said mud plate is slidingly disposed on said leg, and movement of said mud plate toward the top end of said leg is limited by said stop, and a collapsed configuration in which two of said two or more locking pins are inserted in said two locking holes with at least one flange of said pair of flanges interposed between said two locking holes, said mud plate is disposed adjacent the underside of said seat, said anchoring post is removably received in the mud plate's center hole, said leg is removably received in the apertures of said pair of retaining flanges, the side edge of said mud plate is disposed between the retaining flanges, and the side edge of said mud plate is captured between said leg and the underside of said seat.

* * * * *